US010697644B2

(12) United States Patent
Donarski et al.

(10) Patent No.: US 10,697,644 B2
(45) Date of Patent: Jun. 30, 2020

(54) ELECTRIC OVEN WITH A CLOSED-DOOR BROILING OPERATION

(71) Applicant: Whirlpool Corporation, Benton Harbor, MI (US)

(72) Inventors: Robert S. Donarski, Stevensville, MI (US); John F. Hines, Stevensville, MI (US); James C. Johncock, Shelbyville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 254 days.

(21) Appl. No.: 15/895,339

(22) Filed: Feb. 13, 2018

(65) Prior Publication Data

US 2018/0195735 A1 Jul. 12, 2018

Related U.S. Application Data

(62) Division of application No. 13/316,651, filed on Dec. 12, 2011, now Pat. No. 9,920,934.

(51) Int. Cl.

| | |
|---|---|
| ***F24C 7/00*** | (2006.01) |
| ***F24C 7/08*** | (2006.01) |
| ***A21B 1/06*** | (2006.01) |

(52) U.S. Cl.

CPC ..... *F24C 7/085* (2013.01); *F24C 7/087* (2013.01)

(58) Field of Classification Search

CPC ..... F24C 7/00–008; F24C 7/06–067; F24C 7/08–088; A21B 1/00–22

See application file for complete search history.

(56) References Cited

U.S. PATENT DOCUMENTS

| | | | | |
|---|---|---|---|---|
| 2,748,244 | A | 5/1956 | Nellis | |
| 3,270,183 | A * | 8/1966 | Jordan | F24C 14/02 219/398 |
| 3,367,316 | A | 2/1968 | Eff | |
| 3,751,632 | A | 8/1973 | Kauranen | |
| 4,345,145 | A * | 8/1982 | Norwood | A47J 37/0623 219/408 |
| 4,377,738 | A | 3/1983 | Berg | |
| 5,280,157 | A | 1/1994 | Hornung | |
| 5,321,232 | A | 6/1994 | Ogle | |
| 5,362,946 | A * | 11/1994 | Matsushima | H05B 6/6417 219/704 |
| 5,786,996 | A * | 7/1998 | Vitkus | G05B 19/0428 219/413 |
| 6,175,103 | B1 | 1/2001 | Lam et al. | |
| 6,570,136 | B1 | 5/2003 | Lockwood et al. | |
| 7,060,941 | B1 | 6/2006 | Embury et al. | |
| 9,677,771 | B2 * | 6/2017 | Armstrong | F24C 15/022 |
| 2016/0076776 | A1 * | 3/2016 | Gardner | F24C 7/085 126/197 |
| 2016/0076777 | A1 * | 3/2016 | Wait | F24C 7/085 126/197 |

FOREIGN PATENT DOCUMENTS

WO WO 2011080098 * 7/2011

OTHER PUBLICATIONS

"Free-Standing, Slide-In, and Drop-In Electric Ranges", Owners Manual, GE Appliances, Article 49-80637-1 11-11 GE.

* cited by examiner

*Primary Examiner* — Michael A Laflame, Jr.

(74) *Attorney, Agent, or Firm* — Everett G. Diederiks, Jr.

(57) ABSTRACT

An electric oven broils foodstuffs with either its oven door opened or closed. The operating parameters of the oven's broiling elements are altered based on the position of the door.

20 Claims, 4 Drawing Sheets

ELECTRIC OVEN WITH A CLOSED-DOOR BROILING OPERATION

CROSS-REFERENCE TO RELATED APPLICATIONS

This application represents a divisional application of application Ser. No. 13/316,651, titled "Method for Performing a Closed-Door Broiling Operation with an Electric Oven" and filed on Dec. 12, 2011, pending. The entire content of this application is incorporated herein by reference.

TECHNICAL FIELD

The present disclosure relates generally to cooking ovens and more particularly to electric cooking ovens.

BACKGROUND

An electric cooking oven is used to cook meals and other foodstuffs. The oven typically includes a broiling element that is operated to broil foodstuffs such as meat. A broiling operation is generally preformed with the oven door open in the case of an electric oven to prevent the foodstuffs from being overcooked.

SUMMARY

According to one aspect, a method of operating an electric oven includes generating a door-open signal if an oven door of the electric oven is positioned in an open position. An electric broiling element of the electric oven is activated to perform an open-door broil operation in response to generation of the door-open signal. The temperature within a cooking chamber of the electric oven is determined during the open-door broil operation and the electric broiling element is deactivated if the temperature within the cooking chamber exceeds a first shutoff temperature. The method also includes generating a door-closed signal if an oven door of the electric oven is positioned in a closed position. The electric broiling element of the electric oven is activated to perform a closed-door broil operation in response to generation of the door-closed signal. The temperature within a cooking chamber of the electric oven is determined during the closed-door broil operation and the electric broiling element is deactivated if the temperature within the cooking chamber exceeds a second shutoff temperature. The second shutoff temperature is greater than the first shutoff temperature.

During performance of the closed-door broil operation, the electric broiling element may be operated at a predetermined power level for an initial period of time. Subsequent to the initial period of time, the electric broiling element may be cycled between the predetermined power level and a lower power level at a predetermined duty cycle.

During performance of the closed-door broil operation, the electric broiling element may be operated at a predetermined maximum power level for the initial period of time and, subsequent to the initial period of time, cycled between the predetermined maximum power level and a zero power level at the predetermined duty cycle.

During performance of the open-door broil operation, the electric broiling element may be operated at the predetermined power level. It may also be operated at the predetermined maximum power level.

During performance of the closed-door broil operation, a first-broil-mode signal may be generated based on a first user-selected input. In response to generation of the first-broil-mode signal, the electric broiling element may be cycled between a predetermined power level and a lower power level at a first predetermined duty cycle. During performance of the closed-door broil operation, a second-broil-mode signal may be generated based on a second user-selected input. In response to generation of the second-broil-mode signal, the electric broiling element may be cycled between a predetermined power level and a lower power level at a second predetermined duty cycle. The second predetermined duty cycle is different from the first predetermined duty cycle.

During performance of such a closed-door broil operation, the electric broiling element may be cycled between a predetermined maximum power level and a zero power level at the first predetermined duty cycle and between the predetermined maximum power level and the zero power level at the second predetermined duty cycle.

According to another aspect, an electric oven includes a cooking chamber and an oven door movable between a closed position in which the oven door prevents user access to the cooking chamber, and an open position in which user access is permitted to the cooking chamber. A door position sensor is positioned to sense the position of the oven door. A temperature sensor is positioned to determine the temperature within the cooking chamber. An electric broiling element positioned proximate to an upper surface of the cooking chamber. A control unit is electrically coupled to the door position sensor, the temperature sensor, and the electric broiling element. The control unit is configured to (a) monitor output from the door position sensor to determine if the oven door is positioned in the open position, (b) activate the electric broiling element to perform an open-door broil operation if the oven door is positioned in the open position, (c) monitor output from the temperature sensor to determine the temperature within a cooking chamber of the electric oven during the open-door broil operation and deactivate the electric broiling element if the temperature within the cooking chamber exceeds a first shutoff temperature, (d) monitor output from the door position sensor to determine if the oven door is positioned in the closed position, (e) activate the electric broiling element to perform a closed-door broil operation if the oven door is positioned in the closed position, and (f) monitor output from the temperature sensor to determine the temperature within a cooking chamber of the electric oven during the closed-door broil operation and deactivate the electric broiling element if the temperature within the cooking chamber exceeds a second shutoff temperature, the second shutoff temperature being greater than the first shutoff temperature.

The control unit may be further configured to (a) operate the electric broiling element during the closed-door broil operation at a predetermined power level for an initial period of time, and (b) subsequent to the initial period of time, cycling the electric broiling element during the closed-door broil operation between the predetermined power level and a lower power level at a predetermined duty cycle.

The control unit may also be configured to operate the electric broiling element during the open-door broil operation at the predetermined power level.

Further, the control unit may be configured to (a) operate the electric broiling element during the closed-door broil operation at a predetermined maximum power level for an initial period of time, and (b) subsequent to the initial period of time, cycling the electric broiling element during the closed-door broil operation between the predetermined maximum power level and a zero power level at a predetermined duty cycle.

The control unit may also be configured to operate the electric broiling element during the open-door broil operation at the predetermined maximum power level.

The electric oven may also include a user-operated control electrically coupled to the control unit. In such an embodiment, the control unit may be further configured to (a) monitor output from the user-operated control and generate a first-broil-mode signal based on a first user-selected input, (b) cycle the electric broiling element between a predetermined power level and a lower power level at a first predetermined duty cycle in response to generation of the first-broil-mode signal, (c) monitor output from the user-operated control and generate a second-broil-mode signal based on a second user-selected input, and (d) cycle the electric broiling element between the predetermined power level and the lower power level at a second predetermined duty cycle in response to generation of the second-broil-mode signal, the second predetermined duty cycle being different from the first predetermined duty cycle.

In a similar embodiment, the control unit may also be configured to (a) cycle the electric broiling element between a predetermined maximum power level and a zero power level at the first predetermined duty cycle in response to generation of the first-broil-mode signal, and (b) cycle the electric broiling element between a predetermined maximum power level and a zero power level at the second predetermined duty cycle in response to generation of the second-broil-mode signal.

According to another aspect, a method of operating an electric oven includes generating a door-closed signal if an oven door of the electric oven is positioned in a closed position. The electric broiling element is operated at a predetermined power level for an initial period of time in response to the door-closed signal. Subsequent to the initial period of time, the electric broiling element may be cycled between the predetermined power level and a lower power level at a predetermined duty cycle.

During such operation, the electric broiling element may be operated at a predetermined maximum power level for the initial period of time, and thereafter cycled between the predetermined maximum power level and a zero power level at the predetermined duty cycle.

BRIEF DESCRIPTION OF THE DRAWINGS

The detailed description particularly refers to the following figures, in which.

DETAILED DESCRIPTION OF THE DRAWINGS

Figure 1:
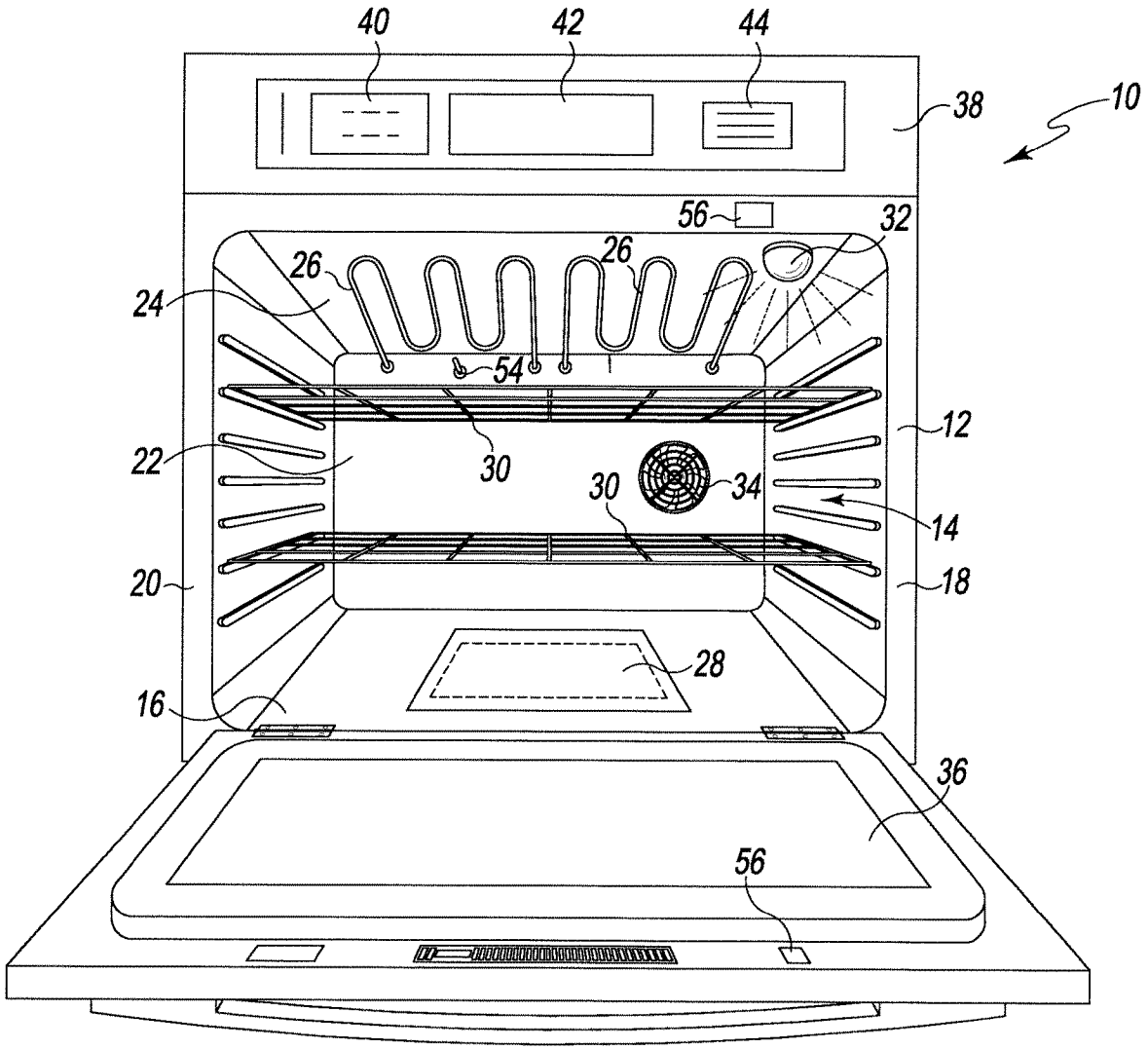
FIG. 1 is a front elevation view of an electric oven.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, there is shown an electric oven 10. The electric oven 10 may be component of a free-standing range, or may be embodied as an in-wall oven assembly (or double oven assembly). The oven 10 includes a housing 12 that defines a cooking chamber 14. The cooking chamber 14 includes a bottom wall 16 having a pair of side walls 18, 20 and a back wall 22 extending upwardly therefrom to a top wall 24.

The oven 10 also includes a number of electric heating elements 26 positioned adjacent the top wall 24, and a number of heating elements 28 located adjacent the bottom wall 16. The heating elements 28 may be hidden below the bottom wall 16, or, alternatively, located above the bottom wall 16. The heating elements 26, 28 heat the cooking chamber 14. In the illustrated embodiment of the oven 10 described herein, the heating elements 26 are electric broil elements (used to broil or "top brown" food) while the heating elements 28 are bake elements (used for baking food).

A number of oven racks 30 are positioned in the cooking chamber 14. The oven racks 30 are supported on their opposite sides by the side walls 18, 20 of the cooking chamber 14. An oven light 32 and optionally, a convection fan 34, are located in the cooking chamber 14.

An oven door 36 is pivotably coupled to the housing 12 by a number of hinges or similar coupling mechanisms. The oven door 36 includes a window, through which the contents of the oven may be viewed. A handle is secured to the front of the oven door 36. The handle facilitates opening and closing of the oven door 36. A vent may also located on the oven door 36.

A console 38 is located above the oven door 36. The console 38 includes the user-operated controls 40 for operating the oven 10. The controls 40 may be embodied as tactile keys, membrane switches, toggle switches, buttons, dials, slides or other suitable control mechanisms. A user utilizes the controls 40 to select a desired operation (e.g., broiling) to be executed by the oven 10. A user may also utilized the controls to select a desired mode of operation (e.g., energy saving) of the oven 10.

The console 38 also includes a display 42 and an audio device 44. The display 42 provides a variety of text messages, graphical icons, and other indicators to inform the user of the status of the oven 10. The audio device 42 outputs audible signals (e.g., a "beep") to alert the user to a condition of the oven, or to prompt the user to take an action relating to operation of the oven.

Figure 2:
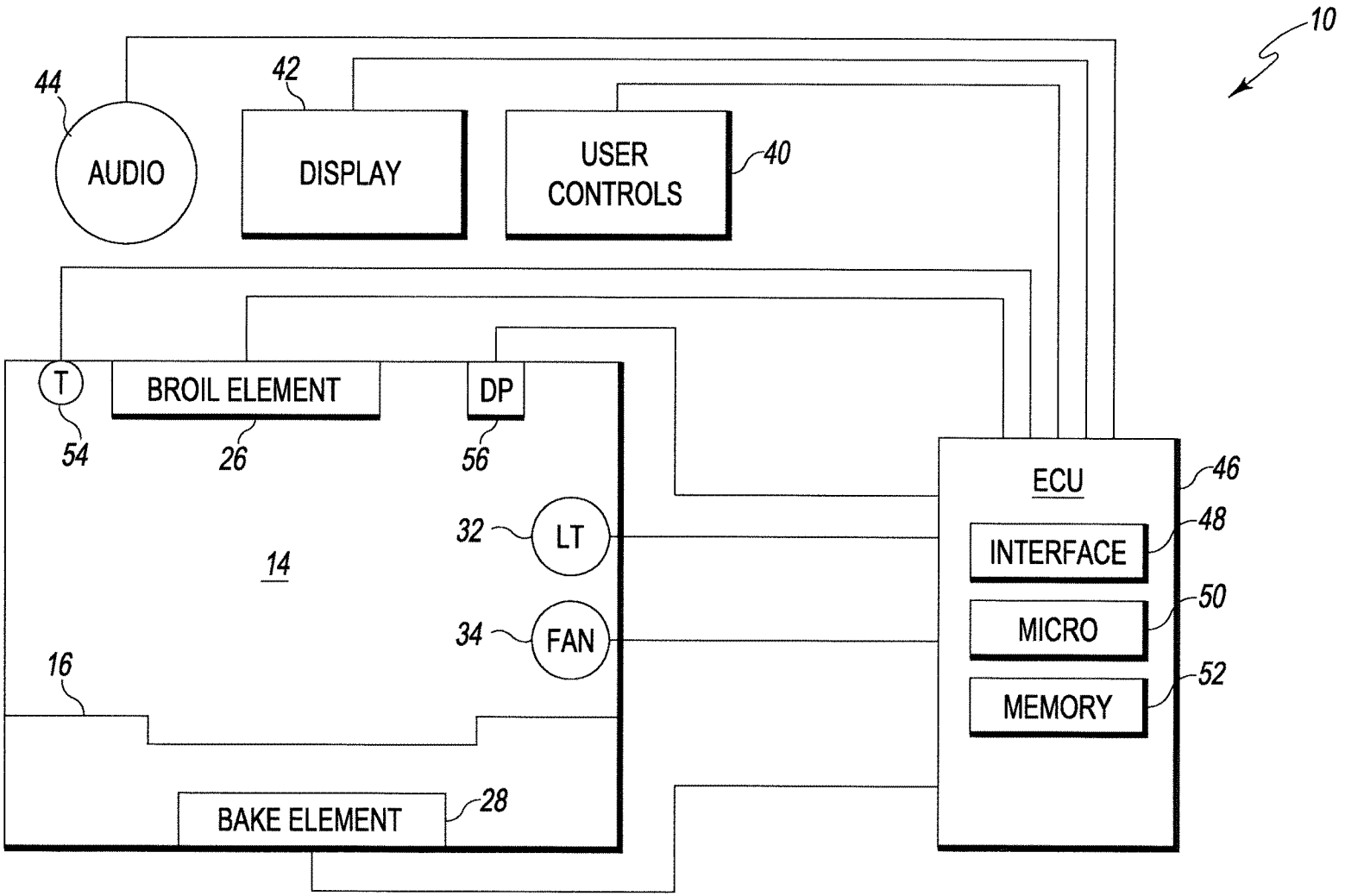
FIG. 2 is simplified block diagram of the control system of the electric oven of FIG. 1.

As shown in FIG. 2, the user controls 40, the display 42, and the audio device 44 are electrically coupled to an electronic control unit 46. The electronic control unit 46 is mounted in the console 38; however, it may be installed at any suitable location within the oven 10.

The electronic control unit 46 interprets electrical signals issued by sensing or detecting components of the oven 10 (e.g., electronic or electromechanical sensors, switches, relays and the like) and activates or energizes electronic or electromechanical components associated with the oven 10 (e.g. an oven light, fan, door lock, or heating element), as shown schematically in FIG. 2.

In general, the electronic control unit 46 performs computer operations, such as reading data, calculating values, counting elapsed time, executing pre-programmed logic, and comparing data to predetermined values, either continuously or intermittently, during operation of the oven 10. Accordingly, the electronic control unit 46 includes an interface 48, a microcontroller or microprocessor 50, and a memory device 52, as well as other electronic components commonly utilized in the control of electromechanical systems.

The interface 48 includes electrical signal processing circuitry. The signal processing circuitry typically includes an analog-to-digital converter (A/D), which converts signals from analog devices in the oven 10 (e.g., a temperature sensor 54 if it generates an analog output signal) into digital signals that are suitable for presentation to an input of the microprocessor 50. The interface 48 also typically includes a digital-to-analog converter (D/A), which converts digital signals output by the microprocessor 50 into an analog form that can be received by the analog devices. The A/D and/or D/A converters may be embodied as discrete devices or number of devices, or may be integrated into the microprocessor 50. Some or all of the sensors used in the oven 10 may generate a digital output signal, in which case the A/D and D/A converters may be bypassed or omitted. Additional signal processing devices may be incorporated into the interface 48, as well.

The memory device 52 includes a programmable non-volatile storage device (e.g. electrically erasable programmable read-only memory or EEPROM), in which computer routines (e.g. firmware or software) executable by the microprocessor 50, as well as certain control parameters used in the operation of the oven 10, are stored.

A number of sensors and/or switches are located in or near the cooking chamber 14 of the oven 10. The temperature sensor 54 is positioned on the back wall 22. The temperature sensor 54 periodically senses the temperature in the cooking chamber 14 and sends temperature signals to the electronic control unit 46. In an illustrated embodiment of the oven 10 described herein, the temperature sensor 54 is embodied as a resistive sensor, such as a Resistance Temperature Detector (RTD) sensor, although another suitable type of temperature sensor may be used.

The oven 10 also includes a door position sensor 56. The door position sensor 56 senses when the door 36 is closed, i.e. flush against the front of the housing 12, and sends a door-closed signal to the electronic control unit 46. In an illustrated embodiment of the oven 10 described herein, the door position sensor 56 is an electrical binary switch that closes when the door is closed.

Figure 3:
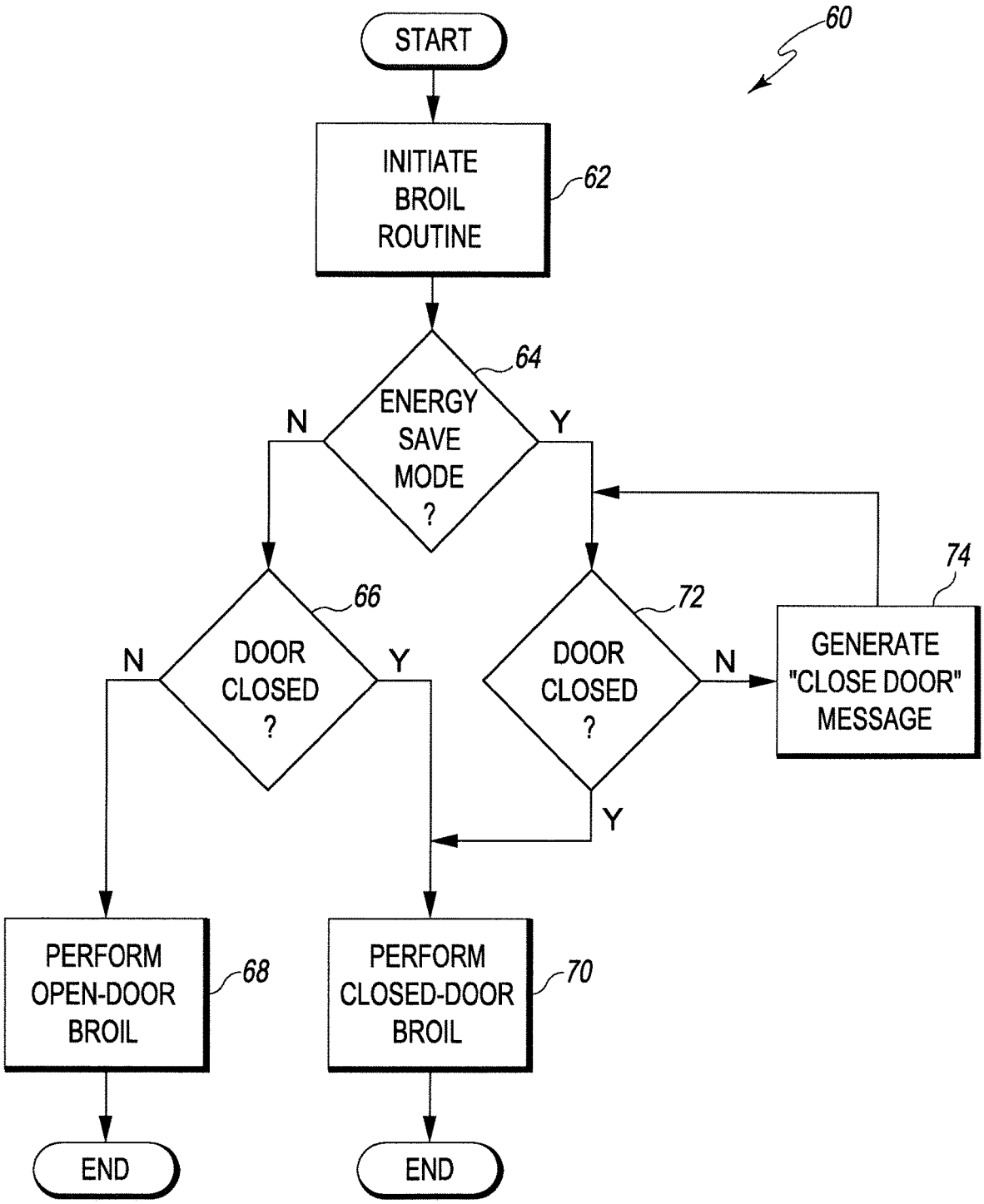
FIG. 3 is a flow diagram showing a broiling routine that is executed by the control system of the electric oven.

The broiling modes of the oven 10 are controlled by the electronic control unit 46. In particular, the electronic control unit 46 executes a broiling control routine 60 stored in the memory device 52 to perform the broiling operations of the oven 10. The control routine 60 is shown in FIG. 3. Parameters that are used during the operation of the broiling modes are configurable during manufacture and/or installation of the oven (e.g. based on specifications and/or performance characteristics of the oven). These parameters are stored in the memory device 52 so that they are not erased during an interruption of power, and they may be updated at a later time (e.g., by a technician). These parameters include data values for the maximum oven temperature, heating and cooling times, and heating element cycling times. These parameters are selectively accessed by the microprocessor 50 at various times during execution of the broiling control routine 60.

Referring to FIG. 3, the electronic control unit 46 executes the broiling control routine 60 upon receipt of a signal from the associated user control 40. The routine 60 commences with step 62 in which control unit 46 receives a user-initiated signal from the user control 40 indicating that user desires to perform a broiling operation. The control unit 46 then initiates such an operation and the control routine 60 advances to step 64. In step 64, the control unit 46 determines if the oven 10 is operating in an energy saving mode or its standard mode. A user may select to operate the oven 10 in its energy saving mode by use of one of the user controls 40. The oven 10 may also be placed in energy saving mode by an automated connection to the Smart Grid (if the oven 10 is embodied with such capability). If the control unit 46 determines the oven 10 is not being operated in energy saving mode (i.e., it is operating in its standard mode), the routine 60 accesses the stored parameters associated with the standard mode and advances to step 66. If the control unit 46 determines the oven 10 is being operated in energy saving mode, the routine 60 accesses the stored parameters associated with the energy saving mode and advances to step 72.

In step 66, the control unit 46 determines if the oven door 36 is closed. Specifically, the control unit 46 scans or otherwise reads its inputs to determine if an input signal is present from the door position sensor 56. If the oven door 36 is open, a control signal is generated that causes the control routine 60 to advance to step 68 to perform a broil operation with the door open (i.e., an open-door broil operation). However, if the control unit 46 determines that the oven door 36 is closed, a control signal is generated that causes the control routine 60 to advance to step 70 to perform a broil operation with the door closed (i.e., a closed-door broil operation).

In step 68, the control unit 46 operates the electric broil elements 26 to perform a broil operation with the door open. To do so, the control unit 46 first determines if the user has selected a particular broil setting. In particular, a user may select to operate the oven 10 in any one of numerous different broil settings to accommodate the broiling of different types of foodstuffs. For example, a user may select a "HIGH" setting for some foodstuffs such as hamburgers or steaks in which external charring is desirable. However, the user may select other settings such as "MEDIUM" or "LOW" if the use of a "HIGH" setting would result in the burning of the exterior of certain foodstuffs (e.g., bone-in chicken) before the interior reaches a necessary temperature. As such, the oven 10 is configured with multiple broil settings to accommodate various different types of foodstuffs. In the illustrative embodiment described herein, three different broil settings are described (e.g., "LOW", "MEDIUM", and "HIGH"). It should be appreciated, however, that any number of different settings may be used to fit the needs of a given design of the oven 10.

Figure 4:
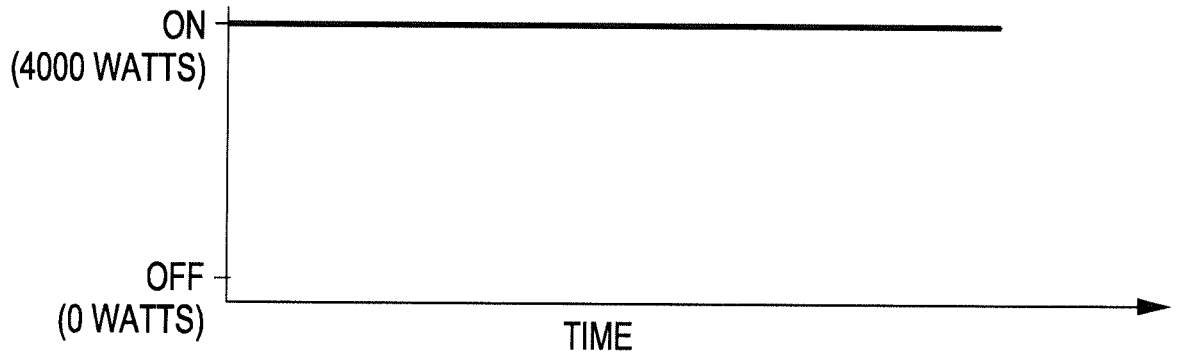
FIGS. 4-6 are power versus time graphs showing the various modes of operation of the electric broiling element during performance of the broiling routine of FIG. 3.

As shown in FIG. 4, if the user selects the "HIGH" broil setting, the control unit 46 operates the electric broil elements 26 at the heating element's highest power setting (e.g., 4,000 Watts). Such a setting is desirable for broiling foodstuffs such as steaks where a seared exterior and cool interior are desired (e.g., rare and medium rare). The control unit 46 continues to operate the electric broil elements 26 at the highest power setting until the user deactivates the broil function via the user control 40 or until the control unit 46 determines from the temperature sensor 54 that a shutoff temperature (e.g., 450° F.) has been achieved in the oven's cooking chamber 14. Since the oven door 36 is open, such a shutoff temperature will generally not be achieved thereby causing the broil operation to continue until ceased by the user.

Figure 5:
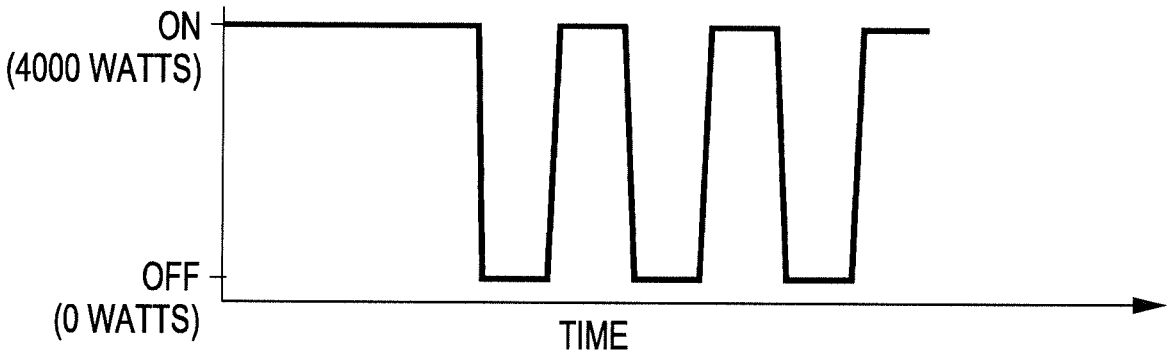

As shown in FIG. 5, if the user selects the "LOW" broil setting, the control unit 46 operates the electric broil elements 26 at the heating element's highest power setting (e.g., 4,000 Watts) for an initial period of time to preheat the broil elements 26. Thereafter, the control unit 46 will toggle the electric broil elements 26 on and off at a preprogrammed duty cycle. For example, when operating in the "LOW" broil setting, the control unit 46 may activate the electric broil elements 26 at the heating element's highest power setting (e.g., 4,000 Watts) for thirty seconds and then deactivate the electric broil elements 26 for thirty seconds. The control unit 46 continues to operate the electric broil elements 26 in such a duty cycle until the user deactivates the broil function via the user control 40.

Figure 6:
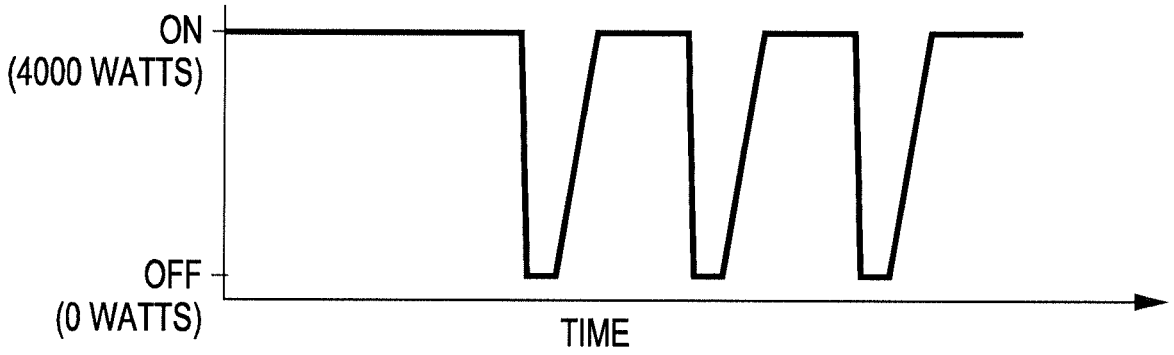

As shown in FIG. 6, if the user selects the "MEDIUM" broil setting, the control unit 46 operates the electric broil elements 26 in a similar manner to the "LOW" setting only with a different preprogrammed duty cycle. Specifically, the control unit 46 initially operates the electric broil elements 26 at the heating element's highest power setting (e.g., 4,000 Watts) for an initial period of time to preheat the broil elements 26. Thereafter, the control unit 46 will toggle the electric broil elements 26 on and off at a preprogrammed duty cycle that is different than the "LOW" duty cycle in that the broil elements 26 are activated for a longer period of time and deactivated for a shorter period of time over the same interval. For example, when operating in the "MEDIUM" broil setting, the control unit 46 may activate the electric broil elements 26 at the heating element's highest power setting (e.g., 4,000 Watts) for forty-five seconds and then deactivate the electric broil elements 26 for fifteen seconds. The control unit 46 continues to operate the electric broil elements 26 in such a duty cycle until the user deactivates the broil function via the user control 40.

Hence, in step 68, the control unit 46 operates the electric broil elements 26 to perform a broil operation with the door open. Such an operation is performed at one of the different broil settings (e.g., "LOW", "MEDIUM", and "HIGH") based on user input and continues until the user deactivates the broil function via the user control 40. Once the user has done so, the broiling control routine 60 then ends.

Referring back to step 66, if the control unit 46 determines that the oven door 36 is closed, the control routine advances to step 70. In step 70, the control unit 46 operates the electric broil elements 26 to perform a broil operation with the oven door 36 closed. A closed-door broil operation can provide significant power savings due to the elimination of heat loss through the open door. To do so, however, the control unit 46 first adjusts the shutoff temperature of the electric broil elements 26. In particular, as described above, during an open door broil operation if the control unit determines from the temperature sensor 54 that a shutoff temperature (e.g., 450° F.) has been achieved in the oven's cooking chamber 14, the broil heating elements are deactivated. However, with the oven door 36 closed, such a shutoff temperature will be quickly achieved (due to the lack of heat loss through the open door). This may result in deactivation of the electric broil elements 26 before the desired food preparation has occurred (e.g., prior to proper searing of foodstuffs such as hamburgers or steaks). To overcome this, the control unit 46 utilizes an increased shutoff temperature (e.g., 550° F.) when performing a broiling operation with the oven door 36 closed.

The control unit 46 utilizes such an increased closed-door shutoff temperature to control the electric broil elements 26 to maintain a desired broiling temperature within the oven's cooking chamber 14. One way to do so is similar to as described above in regard FIGS. 5 and 6 in that the control unit 46 initially operates the electric broil elements 26 at the heating element's highest power setting (e.g., 4,000 Watts) for an initial period of time to preheat the broil elements 26. Thereafter, the control unit 46 will toggle the electric broil elements 26 on and off at a preprogrammed duty cycle that creates a temperature profile within the oven's cooking chamber 14 to adequately broil the foodstuffs within the oven's cooking chamber 14 with the oven door 36 closed. In doing so, the control unit 46 continues to operate the electric broil elements 26 in such a duty cycle until the user deactivates the broil function via the user control 40 or until the control unit 46 determines from the temperature sensor 54 that the increased closed door shutoff temperature (e.g., 550° F.) has been achieved in the oven's cooking chamber 14.

Alternatively, in lieu of using a time-based preprogrammed duty cycle routine, the control unit 46 may utilized closed-loop control to creates a temperature profile within the oven's cooking chamber 14 to adequately broil the foodstuffs within the oven's cooking chamber 14 with the oven door 36 closed. For example, the control unit 46 may execute a proportional—integral—derivative (PID) control routine in which the electric broil elements 26 are activated and deactivated in closed-loop control targeted around the increased closed door shutoff temperature (e.g., 550° F.).

In either the case of closed-loop control (e.g., PID) or timing-based control (e.g., duty cycling), the increased closed door shutoff temperature (e.g., 550° F.) is utilized to allow for increased temperature within the oven's cooking chamber 14 during a broiling procedure with the oven door closed 36 thereby facilitating adequate preparation of foodstuffs relative to operation of the electric broil elements 26 with the lower open-door shutoff temperature (e.g., 450° F.).

Hence, in step 70, the control unit 46 operates the electric broil elements 26 to perform a broil operation with the oven door 36 closed. Such an operation continues until the user deactivates the broil function via the user control 40. Once the user has done so, the broiling control routine 60 then ends.

Referring back to step 64 of the broiling control routine 60 shown in FIG. 3, if the control unit 46 determines the oven 10 is being operated in energy saving mode, the routine 60 advances to step 72. In a similar manner to as described above in regard to step 66, in step 72 the control unit 46 determines if the oven door 36 is closed. Specifically, the control unit 46 scans or otherwise reads its inputs to determine if an input signal is present from the door position sensor 56. If the oven door 36 is closed, the control routine 60 advances to step 70 to perform a broil operation with the door closed in the manner described above. However, if the control unit 46 determines that the oven door 36 is open, the control routine advances to step 74.

In step 74, the control unit 46 generates a signal to issue a "CLOSE DOOR" indicator to the display 42 and/or the audio device 42. Such a indicator functions as an instructional message to a user to inform the user to close the oven door 36. Once the "CLOSE DOOR" message has been generated, the control routine 60 then loops back to step 72 to monitor the user's compliance with the instruction (i.e., to monitor whether the user has closed the oven door 36).

As described herein, the control unit 46 of the electric oven 10 is configured such that a higher shutoff temperature (e.g., 550° F.) is utilized during a broiling procedure with the oven door closed relative to the lower shutoff temperature (e.g., 450° F.) utilized during a broiling procedure with the oven door open. It should be appreciated that the exemplary closed-door shutoff temperature (e.g., 550° F.) and open-door temperature (e.g., 450° F.) described herein are illustrative in nature. Such shutoff temperatures may be varied to fit the design of a given electric oven and may be influenced by numerous design factors such as, amongst others, broiling element design and location.

As also described herein, at certain user-selected settings the electric broil elements 26 are duty cycled after an initial period of time to preheat the elements 26. It should be appreciated that the magnitude of such duty cycling may be varied during a given broiling procedure. In other words, the control routine may be altered to vary the duty cycle of the electric broil elements 26 during performance of a broiling operation. A number of different inputs may be used to determine the degree to which the duty cycle is varied. For example, the sensed temperature with the oven's cooking chamber 14, the output from a meat probe (not shown), or the operational state of a convection fan may be used, amongst other things, as inputs to alter the duty cycle of the electric broil elements 26 during performance of a broiling operation.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

For example, although a wall oven is depicted in the drawings, it will be understood by those of skill in the art that the present invention is applicable to range ovens, double ovens, convection ovens, and similar appliances that perform a broiling operation.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. An electric oven comprising:

a cooking chamber, an oven door movable between (i) a closed position in which the oven door prevents user access to the cooking chamber, and (ii) an open position in which user access is permitted to the cooking chamber, a door position sensor positioned to sense the position of the oven door, a temperature sensor positioned to determine the temperature within the cooking chamber, an electric broiling element positioned proximate to an upper surface of the cooking chamber, and a control unit electrically coupled to the door position sensor, the temperature sensor, and the electric broiling element, the control unit being configured to:

(a) monitor output from the door position sensor to determine if the oven door is positioned in the open position, (b) activate the electric broiling element to perform an open-door broil operation if the oven door is positioned in the open position, (c) monitor output from the temperature sensor to determine the temperature within the cooking chamber of the electric oven during the open-door broil operation and deactivate the electric broiling element if the temperature within the cooking chamber exceeds a first shutoff temperature, (d) monitor output from the door position sensor to determine if the oven door is positioned in the closed position, (e) activate the electric broiling element to perform a closed-door broil operation if the oven door is positioned in the closed position, and (f) monitor output from the temperature sensor to determine the temperature within the cooking chamber of the electric oven during the closed-door broil operation and deactivate the electric broiling element if the temperature within the cooking chamber exceeds a second shutoff temperature, the second shutoff temperature being greater than the first shutoff temperature.

2. The electric oven of claim 1, wherein the control unit is further configured to:

(a) operate the electric broiling element during the closed-door broil operation at a predetermined power level for an initial period of time, and (b) subsequent to the initial period of time, cycling the electric broiling element during the closed-door broil operation between the predetermined power level and a lower power level at a predetermined duty cycle.

3. The electric oven of claim 2, wherein the control unit is further configured to operate the electric broiling element during the open-door broil operation at the predetermined power level.

4. The electric oven of claim 1, wherein the control unit is further configured to:

(a) operate the electric broiling element during the closed-door broil operation at a predetermined maximum power level for an initial period of time, and (b) subsequent to the initial period of time, cycling the electric broiling element during the closed-door broil operation between the predetermined maximum power level and a zero power level at a predetermined duty cycle.

5. The electric oven of claim 4, wherein the control unit is further configured to operate the electric broiling element during the open-door broil operation at the predetermined maximum power level.

6. The electric oven of claim 1, further comprising a user-operated control electrically coupled to the control unit, wherein the control unit is further configured to:

(a) monitor output from the user-operated control and generate a first-broil-mode signal based on a first user-selected input, (b) cycle the electric broiling element between a predetermined power level and a lower power level at a first predetermined duty cycle in response to generation of the first-broil-mode signal, (c) monitor output from the user-operated control and generate a second-broil-mode signal based on a second user-selected input, and (d) cycle the electric broiling element between the predetermined power level and the lower power level at a second predetermined duty cycle in response to generation of the second-broil-mode signal, the second predetermined duty cycle being different from the first predetermined duty cycle.

7. The electric oven of claim 6, wherein the control unit is further configured to:

(a) cycle the electric broiling element between a predetermined maximum power level and a zero power level at the first predetermined duty cycle in response to generation of the first-broil-mode signal, and (b) cycle the electric broiling element between a predetermined maximum power level and a zero power level at the second predetermined duty cycle in response to generation of the second-broil-mode signal.

8. An electric oven comprising:

a cooking chamber, an oven door movable between (i) a closed position in which the oven door prevents user access to the cooking chamber, and (ii) an open position in which user access is permitted to the cooking chamber, a door position sensor positioned to sense the position of the oven door, an electric broiling element positioned proximate to an upper surface of the cooking chamber, and a control unit electrically coupled to the door position sensor and the electric broiling element, the control unit being configured to:

(a) monitor output from the door position sensor to determine if the oven door is positioned in the closed position, (b) activate the electric broiling element to perform a closed-door broil operation if the oven door is positioned in the closed position, (c) operate the electric broiling element during the closed-door broil operation at a predetermined power level for an initial period of time, and (d) subsequent to the initial period of time, cycling the electric broiling element during the closed-door broil operation between the predetermined power level and a lower power level at a predetermined duty cycle.

9. The electric oven of claim 8, wherein the control unit is further configured to:

(a) operate the electric broiling element during the closed-door broil operation at a predetermined maximum power level for the initial period of time, and (b) subsequent to the initial period of time, cycling the electric broiling element during the closed-door broil operation between the predetermined maximum power level and a zero power level at the predetermined duty cycle.

10. The electric oven of claim 8, wherein the control unit is further configured to:

(a) monitor output from the door position sensor to determine if the oven door is positioned in the open position, (b) activate the electric broiling element to perform an open-door broil operation if the oven door is positioned in the open position, (c) operate the electric broiling element during the open-door broil operation at a second predetermined power level for a second initial period of time, and (d) subsequent to the second initial period of time, cycling the electric broiling element during the open-door broil operation between the second predetermined power level and a second lower power level at a second predetermined duty cycle.

11. The electric oven of claim 10, wherein the control unit is further configured to:

(a) operate the electric broiling element during the open-door broil operation at a predetermined maximum power level for the second initial period of time, and (b) subsequent to the second initial period of time, cycling the electric broiling element during the open-door broil operation between the predetermined maximum power level and a zero power level at the second predetermined duty cycle.

12. The electric oven of claim 8, further comprising a temperature sensor positioned to determine the temperature within the cooking chamber, wherein the control unit is further configured to:

(a) monitor output from the temperature sensor to determine the temperature within the cooking chamber of the electric oven during the closed-door broil operation and deactivate the electric broiling element if the temperature within the cooking chamber exceeds a door-closed shutoff temperature.

13. The electric oven of claim 12, wherein the control unit is further configured to:

(a) monitor output from the temperature sensor to determine the temperature within the cooking chamber of the electric oven during the open-door broil operation and deactivate the electric broiling element if the temperature within the cooking chamber exceeds a door-open shutoff temperature, the door-open shutoff temperature being less than the door-closed shutoff temperature.

14. The electric oven of claim 8, wherein the control unit is further configured to:

(a) determine if the electric oven is operating in an energy save mode, and (b) monitor output from the door position sensor to determine if the oven door is positioned in the open position, and wherein the electric oven is configured to indicate a "close door" message to a user if both:

i) the electric oven is operating in the energy save mode, and ii) the oven door is positioned in the open position.

15. The electric oven of claim 14, further comprising a user interface, wherein the electric oven is configured to indicate the "close door" message by displaying the "close door" message on the user interface.

16. The electric oven of claim 14, wherein the electric oven is configured to indicate the "close door" message using an audible signal.

17. An electric oven comprising:

a cooking chamber, an oven door movable between (i) a closed position in which the oven door prevents user access to the cooking chamber, and (ii) an open position in which user access is permitted to the cooking chamber, a door position sensor positioned to sense the position of the oven door, an electric broiling element positioned proximate to an upper surface of the cooking chamber, and a control unit electrically coupled to the door position sensor and the electric broiling element, the control unit being configured to:

(a) determine if the electric oven is operating in an energy save mode, (b) monitor output from the door position sensor to determine if the oven door is positioned in the open position, wherein the electric oven is configured to indicate a "close door" message to a user if both:

i) the electric oven is operating in the energy save mode, and ii) the oven door is positioned in the open position, (c) monitor output from the door position sensor to determine if the oven door is positioned in the closed position, (d) activate the electric broiling element to perform a closed-door broil operation if the oven door is positioned in the closed position, (e) operate the electric broiling element during the closed-door broil operation at a predetermined power level for an initial period of time, and (f) subsequent to the initial period of time, cycling the electric broiling element during the closed-door broil operation between the predetermined power level and a lower power level at a predetermined duty cycle.

18. The electric oven of claim 17, further comprising a temperature sensor positioned to determine the temperature within the cooking chamber, wherein the control unit is further configured to:

(a) monitor output from the temperature sensor to determine the temperature within the cooking chamber of the electric oven during the closed-door broil operation and deactivate the electric broiling element if the temperature within the cooking chamber exceeds a door-closed shutoff temperature.

19. The electric oven of claim 17, further comprising a user interface, wherein the electric oven is configured to indicate the "close door" message by displaying the "close door" message on the user interface.

20. The electric oven of claim 17, wherein the electric oven is configured to indicate the "close door" message using an audible signal.

* * * * *